United States Patent [19]

Yasuoka et al.

[11] Patent Number: 4,736,078

[45] Date of Patent: Apr. 5, 1988

[54] METHOD FOR PROCESSING VACUUM SWITCH AND VACUUM SWITCH PROCESSED BY THE METHOD

[75] Inventors: Koichi Yasuoka, Yokohama; Tohru Tamagawa, Chigasaki; Eiji Kaneko, Yokohama; Mitsutaka Homma, Inagi; Satoru Yanabu, Machida; Takumi Funahashi, Yokohama, all of Japan

[73] Assignee: Kabushiki Kaisha Toshiba, Kanagawa, Japan

[21] Appl. No.: 45,754

[22] Filed: Apr. 28, 1987

Related U.S. Application Data

[63] Continuation of Ser. No. 709,068, Mar. 6, 1985.

[30] Foreign Application Priority Data

Oct. 7, 1983 [JP] Japan ..... 58-187069
Mar. 7, 1984 [JP] Japan ..... 59-43151

[51] Int. Cl.[4] ..... H01H 33/66
[52] U.S. Cl. ..... 200/144 B; 148/4; 148/22
[58] Field of Search ..... 200/144 B; 148/4, 22

[56] References Cited

U.S. PATENT DOCUMENTS 4,190,753 2/1980 Gainer ..... 200/144 B
4,419,551 12/1983 Kato ..... 200/144 B
4,420,346 12/1983 Belkin et al. ..... 148/4

FOREIGN PATENT DOCUMENTS 0115292 8/1984 European Pat. Off. .
57-23430 2/1982 Japan .
58-73929 5/1983 Japan .

*Primary Examiner*—Robert S. Macon
*Attorney, Agent, or Firm*—Schwartz, Jeffery, Schwaab, Mack, Blumenthal & Evans

[57] ABSTRACT

A vacuum switch having two main electrodes encased in a vacuum vessel to be operable in opening and closing the main electrodes, is provided with a contact piece made of a copper-chromium alloy secured or formed on at least one of the main electrodes. The operational property of the main electrodes is substantially improved by flowing and interrupting an electric current of a predetermined current density for a number of times through the two main electrodes for improving surface condition of the contact piece by forming a recrystallized layer over the outer surface of the contact piece.

8 Claims, 3 Drawing Sheets

METHOD FOR PROCESSING VACUUM SWITCH AND VACUUM SWITCH PROCESSED BY THE METHOD

This application is a continuation of application Ser. No. 709,068, filed Mar. 6, 1985, now abandoned.

BACKGROUND OF THE INVENTION

This invention relates to a method for processing a vacuum switch utilizing an axial magnetic field in which a contact piece made of a copper-chromium alloy is specifically processed to improve the surface condition thereof. This invention also relates to a vacuum switch made in accordance with the method of this invention.

Vacuum switches utilizing an axial magnetic field are widely known in the art. FIG. 1 illustrates a typical construction of the conventional vacuum switch. In this construction, a vacuum vessel 1 made of a substantially tubular insulating material has two ends closed by flanges 2 and 3. A stationary electrode S and a movable electrode M are provided in opposed relation in the vessel 1, and supported by current carrying rods 4 and 5 that penetrate the flanges 2 and 3 in an air-tight manner. The stationary electrode S comprises a main electrode 6 and a coil electrode 7, while the movable electrode M comprises a main electrode 8 and a coil electrode 9. The electrodes 6, 7, 8 and 9 are basically made of copper. The current carrying rod 5 supporting the movable electrode M is driven in its axial direction by a driving device, not shown. Bellows 10 is provided for ensuring an air-tight condition during the movement of the rod 5 through the flange 3. The coil electrodes 7 and 9 produce an axial magnetic field in parallel with the arc created between the main electrodes 6 and 8 at the time of current interruption. A shield 12 is further provided in the vacuum vessel 1 for preventing deposition of metal vapor created during current interruption on the internal surface of the vessel 1, and further preventing deterioration of the insulation and ultimate damage of the vessel 1.

Both of the electrodes M and S are basically of a similar construction. FIG. 2 illustrates the movable electrode M having the main electrode 8 comprising an electrode 14 and a contact piece 13 secured to the upper surface of the electrode 14. In order to improve the impact-resisting and current interrupting capability and the fusion resisting property of the contact piece 13, various copper alloys are used for producing the contact piece 13. In the above described vacuum switch wherein an axial magnetic field is provided for preventing concentration of arc and improving the current interrupting capability, radial slits 15 are formed along the upper surface of the contact piece 13, as viewed in FIG. 2, so as to improve efficiency of the magnetic field. Furthermore, the coil electrode 9 has a portion formed into a coil which extends circumferentially in a plane perpendicular to the central axis of the current carrying rod 5 for generating the axial magnetic field.

In the above described construction of the conventional vacuum switch, the contact piece 13 made of a copper alloy tends to absorb impurities such as oxygen and hydrogen more than the remaining portions of the electrode M made of copper. Since the impurities tend to react with the copper alloy to form compounds, the impurities cannot be easily removed. Although various methods have been proposed for removing the impurities, methods utilizing glow discharge which is caused by applying a voltage across the electrodes, or utilizing an arc which is produced by passing an electric current through the electrodes are widely used. However, either of the methods requires a considerable length of time which is varied in accordance with the amount of the surface area of the contact piece. Furthermore the impurities contained in the slits 15 and nearby area cannot be removed satisfactorily even by the application of the above described methods.

SUMMARY OF THE INVENTION

An object of this invention is to provide a vacuum switch and a method for producing the same wherein the above described difficulties can be substantially eliminated.

Another object of the invention is to provide a vacuum switch and a method for producing the same wherein the impurities absorbed in the contact piece can be removed effectively and any defects present on the surface of the contact piece can be eliminated sufficiently.

These and other objects of this invention can be achieved in one aspect according to this invention by providing a method for processing a vacuum switch of the type comprising a vacuum vessel, a pair of relatively separable electrodes disposed in the vacuum vessel, and a pair of current carrying rods extending from the electrodes to outside of the vacuum vessel in an air-tight manner, the method being characterized by the steps of providing at least one contact piece made of a copper-chromium alloy on an outer surface of at least one of the electrodes and flowing and interrupting an electric current of a predetermined current density for a predetermined number of times through the electrodes to generate arcs therebetween for improving surface condition of the contact piece.

In another aspect of this invention there is provided a vacuum switch processed by the method described above, in which the contact piece is provided with a recrystalized layer formed over the outer surface of the contact piece.

Preferably the electric current has a current density more than 1000 $A/cm^2$ (in effective value) which is caused to flow and interrupted with the main electrode provided with the contact piece connected as the anode and the other main electrode connected as the cathode, a number of times sufficient for eliminating defects on the surface of the contact piece.

Preferably, another electric current of a current density ranging from 500 to 1000 $A/cm^2$ (in effective value) is caused to flow and interrupted with the main electrode provided with the contact piece connected as the anode and the other main electrode connected as the cathode a number of times sufficient for producing a recrystalized layer of a predetermined thickness on the surface of the contact piece.

DESCRIPTION OF THE PREFERRED EMBODIMENTS

The invention will now be described with reference to FIGS. 3 through 6.

Figure 3:
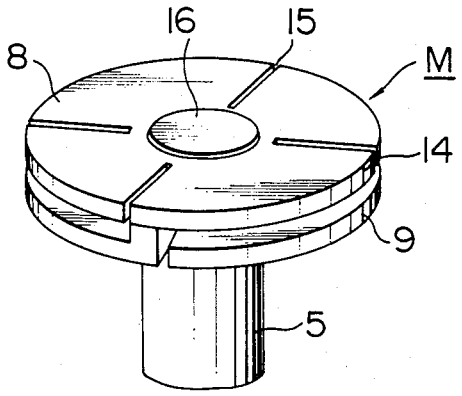
FIG. 3 is a perspective view showing a novel construction of an electrode provided in accordance with this invention.

Since the movable electrode M and the stationary electrode S provided in a vacuum vessel are basically constructed in a similar manner to that described hereinbefore, only the movable electrode M is illustrated in FIG. 3 which comprises a main electrode 8 and a coil electrode 9 supported by a current carrying rod 5. The main electrode 8 further comprises an electrode portion 14 and a contact piece 16 secured on the surface of the electrode portion 14. According to this invention, the contact piece 16 is made of a copper-chromium alloy containing chromium in a range of 20–70%, preferably 25–55% by weight, and formed into a planar configuration. Preferably, the surface area of the contact piece 16 is selected to be substantially equal to or less than 30% of the surface area of the central portion of the electrode portion 14.

Figure 1:
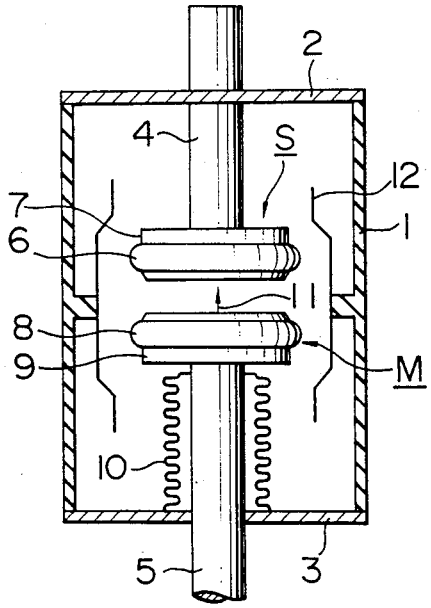
FIG. 1 PRIOR ART
FIG. 1 is a longitudinal sectional view of a conventional vacuum switch.
Figure 2:
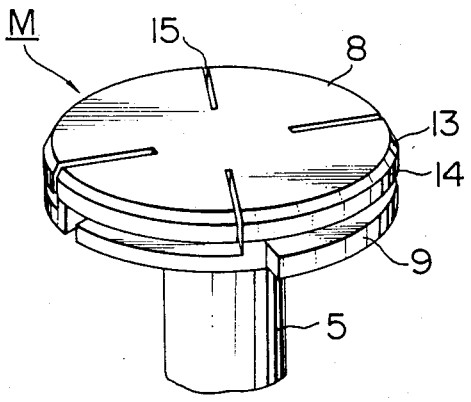
FIG. 2 PRIOR ART
FIG. 2 is a perspective view showing a movable electrode of the conventional vacuum switch shown in FIG. 1.

The movable electrode M of the above described construction is assembled in a vacuum vessel shown in FIG. 1 together with a stationary electrode S of a similar construction with or without the contact piece, and air is removed from the vessel while the thus assembled switch is subjected to a baking process. Then an electric current of a current density higher than 1000 A/cm$^2$ (in effective value) is caused to flow through the electrodes M and S and is interrupted several times while maintaining the movable electrode M having the contact piece 16 as the anode and the stationary electrode S as the cathode, thereby creating arc between the two electrodes for eliminating the impurities and improving the surface condition of the contact piece.

Then an electric current of a current density ranging from 500 to 1000 A/cm$^2$ (in effective value) is cause to flow through the electrodes and is interrupted several times, preferably 2–3 times and less than 10 times, while maintaining the movable electrode M as the cathode and the stationary electrode S as the anode, thereby creating an arc between the two electrodes for creating a recrystalized layer on the surface of the contact piece.

Impurities contained in the electrodes made of copper can be removed comparatively easily by the baking process carried out during the air exhausting process. However, the impurities contained in the contact piece 16 made of copper-chromium alloy cannot be removed sufficiently by the baking process because chromium easily combines with oxygen. The first mentioned arc discharging process is thus required for eliminating impurities from the contact piece made of copper-chromium alloy.

Since the time and energy required for accomplishing the arc discharging process increase in proportion to the surface area of the contact piece 16, a smaller surface area thereof is advantageous from an economical point of view.

According to this invention, the surface area of the contact piece 16 is reduced to approximately 30% of the surface area of the electrode portion 14 supporting the contact piece 16 for economizing the arc discharging process.

Since the reduction of surface area of the contact piece reduces the current interrupting capability of the vacuum switch, the above-described surface area of 30% is found to be advantageous for comprising the two requirements.

Figure 4:
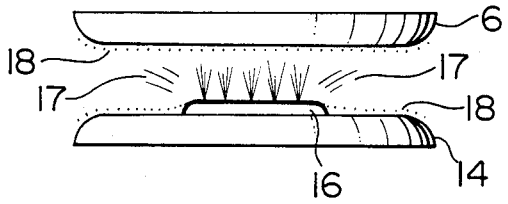
FIG. 4 is a diagram for explaining the method of this invention.
Figure 5:
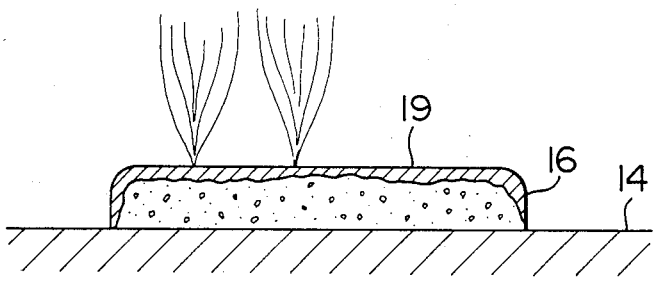
FIG. 5 is a diagram showing an advantageous effect of this invention.

By carrying out the first-mentioned arc discharging process after the baking process, a large amount of metal vapor is delivered from the anode as shown in FIG. 4, most part of which is deposited on the surface of the opposite electrode 6. Since the defects ordinarily present on the copper surface have been substantially eliminated by the baking process, a layer 18 consisting of copper and chromium and therefore having a high impact-resisting property is deposited on the copper surface of the opposite electrode 6 substantially free from the defects.

At the same time, the defects present on the surface of the contact piece 16 are melted by the energy supplied to the anode and eliminated from the surface of the contact piece 16. The layer 18 formed by a single interruption step of the current is thin and weak, easily evaporated by the arc produced during ordinary interrupting operations of the vacuum switch. For this reason, the interruption process utilizing the heavy current density must be repeated several times for increasing the thickness and strength of the deposited layer 18.

The second-mentioned arc discharging process at a current density ranging from 500 to 1000 A/cm$^2$ with the contact piece 16 utilized as a cathode then produces a recrystalized layer 19 on the surface of the contact piece 16, as shown in FIG, 5, whose defects have been eliminated as described before, thereby smoothing the surface of the contact piece 16. At this time, one part of the copper-chromium layer 18 deposited on the surface of the opposing stationary electrode S is vaporized again to be deposited on the contact piece 16 and nearby area. Since no large amount of energy is required in this process, the current density utilized in the process is held in a range of from 500 to 1000 A/cm$^2$. After execution of the arc discharging processes, the surface of the contact piece 16 is made smooth and clean having substantially no defects, and a copper-chromium layer is deposited all over the electrodes of the vacuum switch inclusive of the interior of the slits 15, and particularly with a thickness of about several tens $\mu$m or less than 100 $\mu$m on the contact piece 16, so that the impact-resisting property and the current interrupting property of the electrodes can be substantially improved.

Furthermore, the reduction in size of the contact piece 16 renders the formation of the slits thereon to be utterly unnecessary, thereby reducing the source of trouble to produce defects.

According to this invention, since the electrodes are basically made of copper from which any defect can be eliminated easily, while a small amount of copper-chromium material, which is superior in the impact-resisting and current-interrupting properties, is utilized in the contact piece, the time and cost required for removing defects in the copper-chromium material can be significantly reduced. Furthermore, by executing arc discharging processes in a predetermined sequence, a copper-chromium layer is deposited to cover most of the surfaces of the electrodes, thereby providing a vacuum switch of high impact resistivity and high current-interrupting property in a comparatively simple manner.

Figure 6:
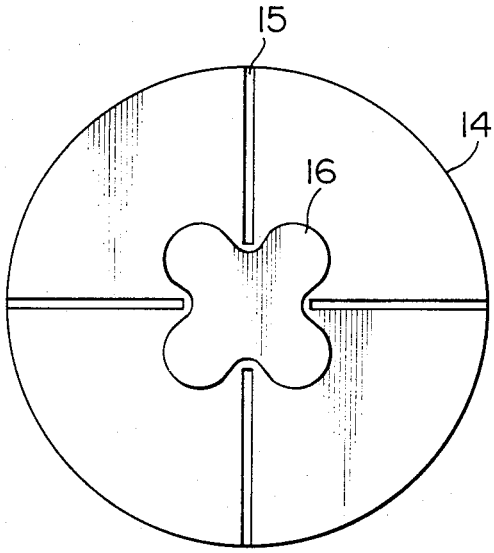
FIG. 6 is a plan view showing another embodiment of this invention.

Although an embodiment utilizing a contact piece of a circular disc-like configuration has been described, it is apparent that the invention is not necessarily restricted to such an embodiment, and a contact piece of, for instance, a rounded cross shape as shown in FIG. 6 adapted to the arrangement of the slits 15 may also be utilized. Although the contact piece is ordinarily provided at the center of the electrode 14, the contact piece may otherwise be provided at an off-center position. The electrode 14 made of copper may also be constructed into any suitable configuration other than the above described circular planar configuration so far as a contact piece of a small surface area can be provided on the electrode.

Furthermore, a plurality of contact pieces may be provided on the electrode 14 instead of the above described single contact piece 16, so far as the copper-chromium material can be deposited evenly on the surfaces of the plurality of contact pieces.

What is claimed is:

1. A method for processing a vacuum switch before carrying out ordinary interruption operations of the vacuum switch, the vacuum switch comprising a pair of relatively movable contacts, a contact surface of at least one contact being made of a copper-chromium alloy, said method comprising:

before carrying out ordinary interruption operations of said vacuum switch, successively flowing through said contacts and interrupting an electric current having a density of about 1000 A/cm$^2$ or higher, sufficient to evaporate a portion of said copper-chromium alloy, a predetermined number of times causing vapor of said copper-chromium alloy on said one contact to deposit onto a contact surface of the other contact thus forming a recrystallized copper-chromium layer.

2. The method according to claim 1 further comprising an additional step of passing through said contacts and interrupting an electric current having a density of about 500–1000 A/cm$^2$ for a predetermined number of times for smoothing a surface of said recrystallized copper-chromium alloy.

3. A method for processing a vacuum switch, comprising the steps of:

intermittently applying a first current to a stationary electrode and a movable electrode of said vacuum switch, said movable electrode being spaced from the stationary electrode in a vacuum vessel, each of said electrodes including a conductive surface area and at least one of said electrodes including a contact piece comprising a portion of a respective said conductive surface area, said contact piece including a copper-chromium alloy, said first current having a density sufficient to create an arc between said electrodes and to evaporate a portion of said copper-chromium alloy, an anode for said current comprising one of said electrodes having a said contact piece, and a cathode for said current comprising the other electrode;

said first current eliminating impurities from said contact piece of said one electrode, and simultaneously depositing metal vapor from said contact piece of said one electrode to the conductive surface area of said other electrode, forming thereby a copper-chromium alloy layer covering said conductive surface area of said other electrode;

intermittently applying to said electrodes a second current having a density sufficient to create an arc between said electrodes, said second current having a polarity opposite that of said first current;

said second current depositing on said one electrode metal vapor from said copper-chromium alloy layer of said other electrode, thereby covering the conductive surface area of said one electrode with a layer of said copper-chromium alloy, and thereby producing a recrystallized layer of said copper-chromium alloy on said contact piece of said one electrode.

4. The method according to claim 3, wherein said first current has a density higher than said second current.

5. The method according to claim 3, wherein said first current density is greater than about 1000 A/cm$^2$.

6. The method according to claim 3, wherein said contact piece of said one electrode comprises no more than about 30% of the respective electrode conductive surface area.

7. The method according to claim 3, wherein said intermittent application of said second current includes applying and interrupting said second current less than 10 times.

8. The method according to claim 7, wherein said second current is applied and interrupted 2 or 3 times.

* * * * *